US006951602B1

(12) United States Patent
Reuter et al.

(10) Patent No.: US 6,951,602 B1
(45) Date of Patent: Oct. 4, 2005

(54) ELECTRODEPOSITION BATH WITH WATER-SOLUBLE POLYVINYL ALCOHOL (CO) POLYMERS

(75) Inventors: Hardy Reuter, Münster (DE); Dagmar Schemschat, Münster (DE); Karl-Heinz Grosse-Brinkhaus, Nottulh (DE); Ulrich Heimann, Münster (DE); Walter Jouck, Münster (DE)

(73) Assignee: BASF Coatings AG, Munster (DE)

( * ) Notice: Subject to any disclaimer, the term of this patent is extended or adjusted under 35 U.S.C. 154(b) by 357 days.

(21) Appl. No.: 10/009,161

(22) PCT Filed: Jun. 29, 2000

(86) PCT No.: PCT/EP00/06035

§ 371 (c)(1),
(2), (4) Date: Dec. 5, 2001

(87) PCT Pub. No.: WO01/02498

PCT Pub. Date: Jan. 11, 2001

(30) Foreign Application Priority Data

Jun. 30, 1999 (DE) ..... 199 30 060

(51) Int. Cl.[7] ..... C25D 13/10

(52) U.S. Cl. ..... 204/489; 204/493; 204/504; 524/901

(58) Field of Search ..... 204/489, 493, 204/497, 504; 524/901

(56) References Cited

U.S. PATENT DOCUMENTS

| | | | | |
|---|---|---|---|---|
| 3,882,008 A | | 5/1975 | Hiraoka et al. | 204/181 |
| 3,922,253 A | | 11/1975 | Jerabek et al. | 260/5 TB |
| 4,134,866 A | | 1/1979 | Tominaga | 260/18 PN |
| 4,172,822 A | | 10/1979 | Patzschke | 260/29.2 |
| 4,416,753 A | | 11/1983 | Batzill et al. | 204/181 |
| 4,444,954 A | | 4/1984 | Mels et al. | 525/124 |
| 4,458,054 A | | 7/1984 | Schmozer et al. | 525/327.3 |
| 4,512,861 A | | 4/1985 | Doroszkowski | 204/181 R |
| 4,710,542 A | | 12/1987 | Forgione et al. | 525/127 |
| 4,711,397 A | | 12/1987 | Lahiff | 239/125 |
| 4,808,658 A | | 2/1989 | Walz et al. | 524/591 |
| 4,824,927 A | | 4/1989 | Dobbelstein et al. | 528/88 |
| 4,865,704 A | | 9/1989 | Saatweber et al. | 204/181.7 |
| 4,870,524 A | | 9/1989 | Coe | 360/135 |
| 4,939,213 A | | 7/1990 | Jacobs, III et al. | 525/329.9 |
| 5,021,502 A | | 6/1991 | Patzschke et al. | 524/591 |
| 5,039,720 A | | 8/1991 | Saatweber et al. | 523/404 |
| 5,084,541 A | | 1/1992 | Jacobs, III et al. | 528/45 |
| 5,101,000 A | | 3/1992 | Paar et al. | 528/111 |
| 5,109,040 A | | 4/1992 | Hönig et al. | 523/411 |
| 5,264,497 A | | 11/1993 | Hönig et al. | 525/453 |
| 5,324,404 A | | 6/1994 | Ott et al. | 525/484 |
| 5,589,049 A | | 12/1996 | Ott et al. | 204/504 |
| 6,146,512 A | * | 11/2000 | Hoefer et al. | 204/502 |
| 6,235,812 B1 | | 5/2001 | Reuter et al. | 523/412 |

FOREIGN PATENT DOCUMENTS

| | | |
|---|---|---|
| CA | 2031671 | 12/1990 |
| CA | 2102169 | 11/1993 |
| CA | 1116548 | 11/2002 |
| DE | 25 10 069 | 9/1975 |
| DE | 43 03 787 C1 | 3/1994 |
| DE | 196 18 379 A1 | 11/1997 |
| EP | 012 463 | 11/1979 |
| EP | 040090 | 5/1981 |
| EP | 245700 | 4/1987 |
| EP | 262 069 | 6/1987 |
| EP | 259 181 | 9/1987 |
| EP | 333 327 | 2/1989 |
| EP | 456270 | 5/1991 |
| EP | 624 577 | 5/1994 |
| EP | 640 700 | 8/1994 |
| JP | 53094346 | 8/1978 |
| JP | 56044799 | 4/1981 |
| JP | 06-248204 | 2/1993 |
| JP | 06248200 | 6/1994 |
| JP | 2001-11201 | 1/2001 |
| WO | WO9208168 | 5/1992 |
| WO | WO9627034 | 9/1996 |
| ZA | 84/05117 | 1/1985 |

OTHER PUBLICATIONS

English Language Abstract for DE4303787C1.
Chemical Abstract Accession No. 84:139359, English Abstract for DE 2510069.
Machine Translation of JP06–248204 provided by JPO.
English Abstract for SU310952.
English Abstract for SU436890.
English Abstract for SU511392.
English Abstract for SU493817.
English Abstract for SU998592.
English Abstract for SU738334.
English Abstract for SU661637.
English Abstract for SU321265.
Methoden der organischen Chemie, Houben–Weyl, vol. 14/2, 4th edition, Georg Thieme Verlag, Stuttgart 1963, p. 61– to 70 and by W. Siefken, Liebags Annalen der Chemie, vol. 562, pp. 75 to 136.
Glasurit Handbuch Lacke und Farben, Curt R. Vincentz Verlag, Handbuch, 1984, pp. 374 to 384 and pp. 457 to 462.
English Abstract for JP56044799.
English Abstract for JP 06248200.
English Abstract for JP2001–011201.
English Abstract for JP53094346 and JP79028410.
English Abstract for JP73008702.
English Abstract for JP6248200.
English Abstract for DE3324211.

* cited by examiner

*Primary Examiner*—Kishor Mayekar

(57) ABSTRACT

The invention relates to the use of a water-soluble polyvinyl alcohol (co)polymer or a mixture of polyvinyl alcohol (co)polymers as additives in aqueous electrodeposition baths, to electrodeposition baths comprising a polyvinyl alcohol (co)polymer, and to a method of coating an electrically conductive substrate.

10 Claims, No Drawings

ELECTRODEPOSITION BATH WITH WATER-SOLUBLE POLYVINYL ALCOHOL (CO) POLYMERS

CROSS REFERENCE TO RELATED APPLICATIONS

This application is a National Phase Application of Patent Application PCT/EP00/06035, filed on 29 Jun. 2000, which claims priority to DE 199 30 060.7, filed on 30 Jun. 1999.

BACKGROUND OF THE INVENTION

The invention relates to a novel use of water-soluble polyvinyl alcohol (co)polymers, to an electrodeposition bath comprising polyvinyl alcohol (co)polymers, and to coated substrates produced using same.

Electrodeposition coating is a well-known method of coating the surface of electrically conducting articles (compare, for example, Glasurit Handbuch Lacke und Farben, Curt R. Vincentz Verlag, Hanover, 1984, pages 374 to 384 and pages 457 to 462, and also DE-A-35 18 732, DE-A-35 18 770, EP-A-0 040 090, EP-A-0 012 463, EP-A-0 259 181, EP-A-0 433 783 and EP-A-0 262 069). The method is used to coat objects made of metal, especially for the priming of automobile bodies, or else to coat conductive plastics.

The coating materials used in electrodeposition coating generally comprise amino or carboxyl-containing synthetic resin binders, with dispersibility in water being achieved by neutralization of the amino or carboxyl groups. The electrodeposition coating materials may further include special grinding resins and possibly further constituents not dispersible in water, such as polymers, plasticizers, pigments, fillers, additives, and auxiliaries. The crosslinking agents used in the electrodeposition coating materials either are not dispersible in water or may be water-dispersible, with the electrodeposition coating materials being externally crosslinking or else self-crosslinking, or being curable with condensation.

Modification to the binders, selection of the crosslinkers, and variation of the composition of the ingredients of the electrodeposition coating material influence the properties of the coating, such as corrosion protection, adhesion, and leveling, for example. For instance, there have been disclosures in particular of electrodeposition coating materials where by adding polymer microparticles or suspended and/or dispersed polymer powders the intention is to exert a favorable influence on corrosion protection, especially at edges, [lacuna] on leveling.

For instance, EP-A-0 259 181 recommends remedying the increased susceptibility to corrosion which is observed at edges of the coated substrate and is caused by a paint film of insufficient thickness by adding polymer microgels, possible ingredients of such microgels being, for example, poly(meth)acrylate copolymers in combination with ethylenically unsaturated vinyl compounds.

Microgel dispersions which are based on epoxy-amine adducts and can be added subsequently are notable for their high compatibility and efficacy as edge protection additives, as described in EP 0 626 000.

DE-B-26 50 611, EP-A-0 052 831, DE-A-39 40 782, EP-A-0 433 783, SU-A-436890, JP-A-53094346, JP-A-79028410 and JP-A-0624820 describe electrodeposition coating compositions with suspendable or dispersible polymer powders which are predominantly free from ionic groups, are able to melt on baking if desired, and are uncrosslinked or crosslinked, said coating compositions further comprising the water-dispersible synthetic resins that are typical of electrodeposition coatings. The particle sizes of such polymer powders may considerably exceed the particle sizes of the water-dispersible synthetic resins of known electrodeposition coating materials: the average particle diameter in JP-A-0624820 is from 1 to 50 micrometers and in DE-A-39 40 782 or EP-A-0 433 783 is from 0.1 to 100 micrometers.

In many cases, the addition of the polymer particles described in EP-A-0 259 181, DE-B-26 50 611, EP-A-0 052 831, EP-A-0 433 783, SU-A-436890, JP-A-53094346, JP-A-79028410 and JP-A-0624820 to aqueous electrodeposition coating materials leads to an improvement in edge coverage. On the other hand, despite the improved edge coverage, the corrosion protection afforded by the deposited electrodeposition coating films, especially at the edges, is inadequate.

Disadvantageous side effects of adding polymer powders include a deterioration in the throwing power of the electrodeposition coating materials and in adhesion to the substrate and/or to subsequent coatings, such as paint films applied subsequently or PVC underbody protection, impairment of the mechanical properties, such as flexibility, stretchability, fracture strength and impact strength, poorer flow properties, and a drastic deterioration in leveling.

A furthermore [sic] key disadvantage of the aqueous and nonaqueous formulations described in the patents EP-A-0 259 181, DE-B-26 50 611, EP-A-0 052 831, EP-A-0 433 783, SU-A-436890, JP-A-53094346, JP-A-79028410, JP-A-0624820, SU-A-661637, SU-A-998592 and SU-A-310952 is the inadequate stability of the coating materials, which tend toward sedimentation. In aqueous electrodeposition coating materials, this may result in massive coverage of the ultrafiltration membrane with coarse polymer particles.

The stability disadvantages of the coating materials are alleviated by incorporating copolymers having vinyl acetal, vinyl alcohol and ethylene units directly into the resins, and/or by grafting reaction, as described in DE 196 18 379.

In this case a fraction of more than 10% by weight of polymer resin is needed in order to achieve sufficient edge coverage.

The incorporation of polymer powder or microgels requires fractions in the percent range, with a deterioration—in some instances drastic—in leveling.

Significantly more effective, even at low concentrations such as 500 ppm, in the electrodeposition coating material are water-soluble cellulose ethers, such as hydroxyethylcellulose (EP 0 640 700). The activity does not last, since the polymer degrades.

Polyvinyl alcohols are used multifariously in coating materials, in particular as suspension stabilizers for the polymerization of vinyl monomers. Whereas the use of polyvinyl alcohols as complexing agents and suspension stabilizers in the pretreatment of iron, steel, zinc and aluminum sheets, in combination with chromates and/or fluorine compounds, is known (J 73008702, WO 9627034), especially the electrophoretic deposition of metal suspensions, such as aluminum (SU 738334, J-A-111201), metal oxide suspensions, such as of chromium, aluminum, titanium and zirconium oxides (J-A-111201, SU 493817), metal salt suspensions, such as of lead, zinc or copper salts (SU 436890, SU 511392, SU 054452, WO 9208168), and also direct deposition of metals, such as lead (SU 321265), the direct use in electrodeposition coating materials is restricted to subsequent treatment of the deposited film by contact with an aqueous polyvinyl alcohol solution followed by baking. This subsequent treatment achieves a flatting effect (JP 56044799) or reduces surface defects, such as craters (DE 4303787).

DETAILED DESCRIPTION

Against this background, the technical problem on which the invention is based is that of specifying an electrodeposition coating bath that gives coatings which meet all of the requirements in respect of edge protection and contamination resistance, especially to oils, said coatings simultaneously being uncomplicated to prepare and having long-term stability.

To solve this technical problem, the invention teaches the use of a water-soluble polyvinyl alcohol (co)polymer or of a mixture of polyvinyl alcohol (co)polymers as an additive in aqueous electrodeposition coating baths.

Aqueous electrodeposition coating baths contain little if any organic solvent.

The expression water-soluble means a true solution process in water and not a dispersion of particulate units at a supermolecular level. Preferably, the polyvinyl alcohol (co) polymer is prepared as an additive in aqueous solution, where appropriate with customary coatings additaments, and the aqueous solution is added to the electrodeposition bath. The expression "additive" defines the presence of the polyvinyl alcohol (co)polymer as a molecularly independent unit in the electrodeposition bath and in particular not as a component incorporated reactively into a binder, resin or the like. This definition does not of course rule out in a deposited coating the polyvinyl alcohol (co)polymer being incorporated reactively into the other ingredients of the deposited coating.

In the context of the present invention, the term polyvinyl alcohol (co)polymer refers to a random copolymer or block copolymer comprising polymer building blocks of the general formula I, or a homopolymer consisting of polymer building blocks of the general formula I, the polyvinyl alcohol copolymers being of advantage in accordance with the invention and therefore being employed with preference.

$$-[-C(R^1)_2-C(R^1)(OH)-]- \quad (I)$$

In the polyvinyl alcohol (co)polymers for use in accordance with the invention the polymer building blocks I may be linked head to head or head to tail.

Advantageously, by far the predominant proportion of the polymer building blocks I are linked head to tail.

In the general formula I, the variable $R^1$ stands for hydrogen atoms or for substituted or unsubstituted alkyl, cycloalkyl, alkylcycloalkyl, cycloalkylalkyl, aryl, alkylaryl, cycloalkylaryl, arylalkyl or arylcycloalkyl radicals.

Examples of suitable alkyl radicals are methyl, ethyl, propyl, isopropyl, n-butyl, isobutyl, tert-butyl, amyl, hexyl, and 2-ethylhexyl.

Examples of suitable cycloalkyl radicals are cyclobutyl, cyclopentyl, and cyclohexyl.

Examples of suitable alkylcycloalkyl radicals are methylenecyclohexane, ethylenecyclohexane, and propane-1,3-diylcyclohexane.

Examples of suitable cycloalkylalkyl radicals are 2-, 3- and 4-methyl-, -ethyl-, -propyl-, and -butylcyclohex-1-yl.

Examples of suitable aryl radicals are phenyl, naphthyl, and biphenylyl.

Examples of suitable alkylaryl radicals are benzyl-[sic], ethylene- and propane-1,3-diyl-benzene.

Examples of suitable cycloalkylaryl radicals are 2-, 3-, and 4-phenylcyclohex-1-yl.

Examples of suitable arylalkyl radicals are 2-, 3- and 4-methyl-, -ethyl-, -propyl-, and -butylphen-1-yl.

Examples of suitable arylcycloalkyl radicals are 2-, 3-, and 4-cyclohexylphen-1-yl.

The above-described radicals $R^1$ may be substituted. Electron-withdrawing or electron-donating atoms or organic radicals may be used for this purpose.

Examples of suitable substituents are halogen atoms, especially chlorine or fluorine, nitrile groups, nitro groups, partly or fully halogenated, especially chlorinated and/or fluorinated, alkyl, cycloalkyl, alkylcycloalkyl, cycloalkylalkyl, aryl, alkylaryl, cycloalkylaryl, arylalkyl and arylcycloalkyl radicals, including those exemplified above, especially tert-butyl; aryloxy, alkyloxy and cycloalkyloxy radicals, especially phenoxy, naphthoxy, methoxy, ethoxy, propoxy, butyloxy or cyclohexyloxy; arylthio, alkylthio and cycloalkylthio radicals, especially phenylthio, naphthylthio, methylthio, ethylthio, propylthio, butylthio or cyclohexylthio; hydroxyl groups; and/or primary, secondary and/or tertiary amino groups, especially amino, N-methylamino, N-ethylamino, N-propylamino, N-phenylamino, N-cyclohexylamino, N,N-dimethylamino, N,N-diethylamino, N,N-dipropylamino, N,N-diphenylamino, N,N-dicyclohexylamino, N-cyclohexyl-N-methylamino or N-ethyl-N-methylamino.

It is of advantage in accordance with the invention if the radicals $R^1$ comprise predominantly hydrogen atoms, i.e., if the other radical s $R^1$ are present only to a minor extent. In the context of the present inventions [sic], the term "minor extents" designates an extent which advantageously varies and does not impair or even completely alter the profile of performance properties of the polyvinyl alcohol (co) polymers, especially their solubility in water. Particular advantages result if the radicals $R^1$ comprise exclusively hydrogen atoms, i.e., if the polymer building blocks I are derived from the hypothetical polyvinyl alcohol. Accordingly, polyvinyl alcohol (co)polymers containing these polymer building blocks I are used with particular preference.

Besides the polymer building blocks I, the polyvinyl alcohol copolymers for use in accordance with the invention further comprise, in particular, polymer building blocks of the general formula II.

$$-[-C(R^1)_2-C(R^1)(OC(O)R^2)-] \quad (II)$$

In the general formula II, the radicals $R^1$ have the definition indicated above, hydrogen atoms again being of particular advantage and therefore being employed with particular preference. The radicals $R^2$ stand for alkyl radicals having from one to ten carbon atoms, preferably methyl, ethyl, propyl, isopropyl, n-butyl, isobutyl, tert-butyl, amyl, hexyl, or 2-ethylhexyl, with particular preference methyl. Accordingly, the particularly preferred polymer building blocks II are derived from vinyl acetate. The polymer building blocks II may be linked head to head or head to tail. Advantageously, by far the predominant proportion of the polymer building blocks II are linked head to tail.

The polyvinyl alcohol copolymers may further comprise customary and known ethylenically unsaturated monomers such as (meth)acrylic esters substantially free from acid groups, monomers which carry at least one hydroxyl group per molecule and are substantially free from acid groups, such as hydroxyalkyl esters of acrylic acid, methacrylic acid or another alpha,beta-olefinically unsaturated carboxylic acid which are derived from an alkylene glycol which is esterified with the acid or are obtainable by reacting the alpha,beta-olefinically unsaturated carboxylic acid with an alkylene oxide, monomers which carry per molecule at least one acid group which can be converted into the corresponding acid anion group, vinyl esters of alpha-branched monocarboxylic acids having from 5 to 18 carbon atoms in the molecule, reaction products of acrylic acid and/or methacrylic acid with the glycidyl ester of an alpha-branched monocarboxylic acid having from 5 to 18 carbon atoms per molecule, cyclic and/or acyclic olefins such as ethylene, propylene, but-1-ene, pent-1-ene, hex-1-ene, cyclohexene, cyclopentene, norbornene, butadiene, isoprene, cyclopentadiene and/or dicyclopentadiene, especially ethylene, (meth)acrylamides, monomers containing epoxide groups, such as the glycidyl esters of ethylenically unsaturated carboxylic acids, vinylaromatic hydrocarbons, nitriles, vinyl compounds, especially vinyl halides and/or vinylidene dihalides, N-vinylpyrrolidone or vinyl ethers, allyl compounds, especially allyl ethers and allyl esters.

Where these monomers are used, they are present only in a minor extent in the polyvinyl alcohol copolymers for use in accordance with the invention, this term being employed here again in the sense explained above. Of these monomers, the acyclic olefins, especially ethylene and propylene, in particular ethylene, offer particular advantages and are therefore used with preference where needed.

Advantageously, the polyvinyl alcohol (co)polymers for use in accordance with the invention have a degree of polymerization of from 100 to 20 000, preferably from 200 to 15 000, with particular preference from 300 to 12 000, and in particular from 400 to 10 000.

The amount of polymer building blocks I in the polyvinyl alcohol copolymers is advantageously from 50 to 99.9, with preference from 60 to 99.9, with particular preference from 70 to 99 and in particular from 80 to 99 mol %.

In the context of the present invention, the polyvinyl alcohol copolymers which comprise the particularly advantageous polymer building blocks I and II offer very particular advantages and are therefore used with very particular preference in accordance with the invention. These polyvinyl alcohol copolymers are also referred to for short by those in the art as polyvinyl alcohols.

As is known, the polyvinyl alcohols are not accessible through direct polymerization processes but instead are prepared by way of polymer-analogous reactions by hydrolysis of polyvinyl acetate. Particularly advantageous, commercially customary polyvinyl alcohols have molecular weights of from 10 000 to 500 000 daltons, preferably from 15 000 to 320 000 daltons, and in particular from 20 0000 [sic] to 300 000 daltons. Especially advantageous, commercially customary polyvinyl alcohols have a degree of hydrolysis of from 98 to 99 or from 87 to 89 mol %.

The vinyl alcohol fraction may be determined, for example, indirectly by way of the ester number in accordance with DIN 53401, specifically by determining the remaining fraction of vinyl acetate following hydrolysis by means of the ester number.

The solubility of these polyvinyl alcohols in water may be varied within a wide range by subsequent polymer-analogous modification with aldehydes. As is known, this reaction leads to the formation of cyclic acetals. Examples of suitable acetalized polyvinyl alcohols are known from the patent DE-A-196 18 379.

Surprisingly, the addition of the polyvinyl alcohol (co) polymer, especially polyvinyl alcohol, which is easy to prepare and may be added simply as an additive directly to the electrodeposition bath, achieves edge protection to satisfy every requirement, and very good contamination resistance, especially to oil. The leveling is likewise outstanding. It has been found, furthermore, that only very small amounts of polyvinyl alcohol (co)polymer need be added, leading to a considerable cost advantage over the prior art's added edge protection improvers.

In the context of the invention it is advantageous if the fraction of polyvinyl alcohol (co)polymers, especially polyvinyl alcohols, in the electrodeposition bath is from 2 to 10 000 ppm, preferably from 20 to 5000 ppm, based in each case on the total weight of the electrodeposition bath. If the electrodeposition bath includes pigments (inorganic) in a fraction of more than 10%, based on the solids of the electrodeposition bath, then it is generally sufficient to add an amount of from 2 to 3000, in particular 300 to 1500, ppm.

The use in accordance with the invention is advantageous in the context of all customary anodic or cathodic electrodeposition baths.

These electrodeposition baths are aqueous coating materials having a solids content of in particular from 5 to 30% by weight.

The solids of the bath of the invention comprises (A) customary and known binders which carry ionic groups or functional groups which can be converted into ionic groups, (a1), and also functional groups (a2) capable of chemical crosslinking, and are externally crosslinking and/or self-crosslinking, but in particular externally crosslinking;

(B) if desired, crosslinking agents which carry complementary functional groups (b1) which are able to undergo chemical crosslinking reactions with the functional groups (a2) and are employed mandatorily when the binders (A) are externally crosslinking;

(C) customary and known coatings additives, and (D) the polyvinyl alcohol (co)polymers for use in accordance with the invention and described in detail above, especially polyvinyl alcohols.

Where the crosslinking agents (B) and/or their functional groups (b1) have already been incorporated into the binders (A), the term self-crosslinking is used.

Suitable complementary functional groups (a2) of the binders (A) include, preferably, thio, amino, hydroxyl, carbamate, allophanate, carboxyl, and/or (meth)acrylate groups, but especially hydroxyl groups, and complementary functional groups (b1) include preferably anhydride, carboxyl, epoxy, blocked isocyanate, urethane, methylol, methylol ether, siloxane, amino, hydroxyl and/or beta-hydroxyalkylamide groups, but especially blocked isocyanate groups.

Examples of suitable ionic functional groups, or functional groups which can be converted into ionic groups, (a1), of the binders (A) are (a11) functional groups which can be converted into cations by neutralizing agents and/or quaternizing agents, and/or cationic groups or (a12) functional groups which can be converted into anions by neutralizing agents, and/or anionic groups.

The binders (A) having functional groups (a11) are used in cathodically depositable electrodeposition coating (cathodic electrocoat) materials, while the binders (A) having functional groups (a12) are employed in anodic electrocoat materials.

Examples of suitable functional groups (a11) for use in accordance with the invention that can be converted into cations by neutralizing agents and/or quaternizing agents are primary, secondary or tertiary amino groups, secondary sulfide groups or tertiary phosphine groups, especially tertiary amino groups or secondary sulfide groups.

Examples of suitable cationic groups (a11) for use in accordance with the invention are primary, secondary, tertiary or [sic] tertiary sulfonium groups or quaternary phosphonium groups, preferably quaternary ammonium groups or quaternary ammonium groups [sic], tertiary sulfonium groups, but especially quaternary ammonium groups.

Examples of suitable functional groups (a12) for use in accordance with the invention that can be converted into anions by neutralizing agents are carboxylic acid, sulfonic acid or phosphonic acid groups, especially carboxylic acid groups.

Examples of suitable anionic groups (a12) for use in accordance with the invention are carboxylate, sulfonate or phosphonate groups, especially carboxylate groups.

The groups (a11) or (a12) should be selected so as to rule out the possibility of disruptive reactions with the functional groups (a2) that are able to react with the crosslinking agents (B). The skilled worker will therefore be able to make the selection in a simple manner on the basis of his or her knowledge of the art.

Examples of suitable neutralizing agents for functional groups (a11) convertible into cations are inorganic and organic acids such as sulfuric acid, hydrochloric acid, phosphoric acid, formic acid, acetic acid, lactic acid, dimethylolpropionic acid or citric acid, especially formic acid, acetic acid or lactic acid.

Examples of suitable neutralizing agents for functional groups (a12) convertible into anions are ammonia, ammonium salts, such as ammonium carbonate or ammonium hydrogen carbonate, for example, and also amines, such as trimethylamine, triethylamine, tributylamine, dimethylaniline, diethylamine, triphenylamine, dimethylethanolamine, diethylethanolamine, methyldiethanolamine, triethanolamine and the like.

The amount of neutralizing agent is generally is [sic] chosen so that from 1 to 100 equivalents, preferably from 50 to 90 equivalents, of the functional groups (a11) or (a12) of the binder (b1) are neutralized.

Examples of suitable binders (A) for anodic electrocoat materials are known from the patent DE-A-28 24 418. They comprise preferably polyesters, epoxy resin esters, poly (meth)acrylates, maleate oils or polybutadiene oils having a weight average molecular weight of from 300 to 10 000 daltons and an acid number of from 35 to 300 mg KOH/g.

Examples of suitable cathodic electrocoat materials are known from the patents EP-A-0 082 291, EP-A-0 234 395, EP-A-0 227 975, EP-A-0 178 531, EP-A-333 327, EP-A-0 310 971, EP-A-0 456 270, U.S. Pat. No. 3,922,253, EP-A-0 261 385, EP-A-0 245 786, DE-A-33 24 211, EP-A-0 414 199, and EP-A-476 514. They comprise preferably resins (A) containing primary, secondary, tertiary or quaternary amino or ammonium groups and/or tertiary sulfonium groups and having amine numbers of preferably between 20 and 250 mg KOH/g and a weight average molecular weight of preferably from 300 to 10 000 daltons. In particular, amino (meth)acrylate resins, amono [sic] epoxy resins, amino epoxy resins having terminal double bonds, amino epoxy resins having primary and/or secondary hydroxyl groups, amino polyurethane resins, amino-containing polybutadiene resins, or modified epoxy resin/carbon dioxide/amine reaction products [lacuna].

In accordance with the invention, cathodic electrocoat materials and the corresponding electrodeposition baths are used with preference.

The electrodeposition baths preferably comprise crosslinking agents (B).

Examples of suitable crosslinking agents (B) are blocked organic polyisocyanates, especially blocked polyisocyanates known as paint polyisocyanates, containing blocked isocyanate groups attached to aliphatic, cycloaliphatic, araliphatic and/or aromatic moieties.

They are preferably prepared using polyisocyanates having from 2 to 5 isocyanate groups per molecule and having viscosities of from 100 to 10 000, preferably from 100 to 5000, and in particular from 100 to 2000 mPas (at 23° C.). Moreover, the polyisocyanates may have been subjected to conventional hydrophilic or hydrophobic modification.

Examples of suitable polyisocyanates are described, for example, in "Methoden der organischen Chemie", Houben-Weyl, Volume 14/2, 4th edition, Georg Thieme Verlag, Stuttgart 1963, pages 61 to 70, and by W. Siefken, Liebigs Annalen der Chemie, Volume 562, pages 75 to 136. Examples of those suitable include the isocyanato-containing polyurethane prepolymers which can be prepared by reacting polyols with an excess of polyisocyanates and which are preferably of low viscosity.

Further examples of suitable polyisocyantes are polyisocyanates containing isocyanurate, biuret, allophanate, iminooxadiazinedione, urethane, urea and/or uretdione groups. Polyisocyanates containing urethane groups, for example, are obtained by reacting some of the isocyanate groups with polyols, such as trimethylolpropane and glycerol, for example. It is preferred to use aliphatic or cycloaliphatic poly-isocyanates, especially hexamethylene diisocyanate, dimerized and trimerized hexamethylene diisocyanate, isophorone diisocyanate, 2-isocyanatopropylcyclohexyl isocyanate, dicyclohexylmethane 2,4'-diisocyanate, dicyclohexylmethane 4,4'-diisocyanate or 1,3-bis(iso-cyanatomethyl)cyclohexane (BIC), diisocyanates derived from dimer fatty acids, as sold under the commercial designation DDI 1410 by Henkel, 1,8-diisocyanato-4-isocyanatomethyloctane, 1,7-diisocyanato-4-isocyanato-methylheptane or 1-isocyanato-2-(3-isocyanatopropyl)-cyclohexane, or mixtures of these polyisocyanates.

Examples of suitable blocking agents for preparing the blocked polyisocyanates (B) are the blocking agents known from US patent U.S. Pat. No. 4,444,954, such as i) phenols such as phenol, cresol, xylenol, nitrophenol, chlorophenol, ethylphenol, t-butyl-phenol, hydroxybenzoic acid, esters of this acid, or 2,5-di-tert-butyl-4-hydroxytoluene;

ii) lactams, such as ϵ-caprolactam, δ-valerolactam, γ-butyrolactam or β-propiolactam;

iii) active methylenic compounds, such as diethyl malonate, dimethyl malonate, ethyl or methyl acetoacetate, or acetylacetone;

iv) alcohols such as methanol, ethanol, n-propanol, isopropanol, n-butanol, isobutanol, t-butanol, n-amyl alcohol, t-amyl alcohol, lauryl alcohol, ethylene glycol monomethyl ether, ethylene glycol monoethyl ether, ethylene glycol monobutyl ether, diethylene glycol monomethyl ether, diethylene glycol monoethyl ether, propylene glycol monomethyl ether, methoxymethanol, glycolic acid, glycolic esters, lactic acid, lactic esters, methylolurea, methylolmelamine, diacetone alcohol, ethylenechlorohydrin, ethylenebromohydrin, 1,3-dichloro-2-propanol, 1,4-cyclohexyldimethanol or acetocyanohydrin;

v) mercaptans such as butyl mercaptan, hexyl mercaptan, t-butyl mercaptan, t-dodecyl mercaptan, 2-mercaptobenzothiazole, thiophenol, methylthiophenol or ethylthiophenol;

vi) acid amides such as acetoanilide, acetoanisidinamide, acrylamide, methacrylamide, acetamide, stearamide or benzamide;

vii) imides such as succinimide, phthalimide or maleimide;

viii) amines such as diphenylamine, phenylnaphthylamine, xylidine, N-phenylxylidine, carbazole, aniline, naphthylamine, butylamine, dibutylamine or butylphenylamine;

ix) imidazoles such as imidazole or 2-ethylimidazole;

x) ureas such as urea, thiourea, ethyleneurea, ethylenethiourea or 1,3-diphenylurea;

xi) carbamates such as phenyl N-phenylcarbamate or 2-oxazolidone;

xii) imines such as ethyleneimine;

xiii) oximes such as acetone oxime, formaldoxime, acetaldoxime, acetoxime, methyl ethyl ketoxime, diisobutyl ketoxime, diacetyl monoxime, benzophenone oxime or chlorohexanone oximes;

xiv) salts of sulfurous acid such as sodium bisulfite or potassium bisulfite;

xv) hydroxamic esters such as benzyl methacrylohydroxamate (BMH) or allyl methacrylohydroxamate; or xvi) substituted pyrazoles, ketoximes imidazoles or triazoles; and also mixtures of these blocking agents, especially dimethylpyrazole and triazoles, malonic esters and acetoacetic esters or dimethylpyrazole and succinimide, or butyl diglycol and trimethylolpropane.

Further examples of suitable crosslinking agents (B) are all known aliphatic and/or cycloaliphatic and/or aromatic polyepoxides, based for example on bisphenol A or bisphenol F. Further suitable polyepoxides include, for example, the polyepoxides obtainable commercially under the designations Epikote® from Shell, Denacol® from Nagase Chemicals Ltd., Japan, such as, for example Denacol EX-411 (pentaerythritol polyglycidyl ether), Denacol EX-321 (trimethylolpropane polyglycidyl ether), Denacol EX-512 (polyglycerol polyglycidyl ether), and Denacol EX-521 (polyglycerol polyglycidyl ether).

As crosslinking agents (B) it is also possible to use tris(alkoxycarbonylamino)triazines (TACT) of the general formula

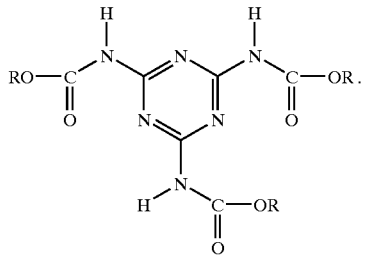

Examples of suitable tris(alkoxycarbonylamino)triazines (B) are described in the patents U.S. Pat. No. 4,939,213, U.S. Pat. No. 5,084,541, and EP-A-0 624 577. Use is made in particular of the tris(methoxy-, tris(butoxy- and/or tris(2-ethylhexoxycarbonylamino)triazines.

The methyl butyl mixed esters, the butyl 2-ethylhexyl mixed esters, and the butyl esters are of advantage. They have the advantage over the straight methyl ester of better solubility in polymer melts, and also have less of a tendency to crystallize out.

Further examples of suitable crosslinking agents (B) are amino resins, examples being melamine resins, guanamine resins, benzoguanamine resins or urea resins. Also suitable are the customary and known amino resins some of whose methylol and/or methoxymethyl groups have been defunctionalized by means of carbamate or allophanate groups. Crosslinking agents of this kind are described in the patens U.S. Pat. No. 4,710,542 and EP-B-0 245 700 and also in the article by B. Singh and coworkers, "Carbamylmethylated Melamines, Novel Crosslinkers for the Coatings Industry", in Advanced Organic Coatings Science and Technology Series, 1991, Volume 13, pages 193 to 207.

Further examples of suitable crosslinking agents (B) are beta-hydroxyalkylamides such as N,N,N',N'-tetrakis(2-hydroxyethyl)adipamide or N,N,N',N'-tetra-kis(2-hydroxypropyl)adipamide.

Further examples of suitable crosslinking agents (B) are compounds containing on average at least two groups amenable to transesterification, examples being reaction products of malonic diesters and polyisocyanates or of monoisocyanates with esters and partial esters of malonic acid with polyhydric alcohols, as described in the European patent EP-A-0 596 460.

The amount of the crosslinking agents (B) in the coating material or electrodeposition bath of the invention may vary widely and is guided in particular, firstly, by the functionality of the crosslinking agents (B) and, secondly, by the number of crosslinking functional groups (a2) which are present in the binder (A), and also by the target crosslinking density. The skilled worker is therefore able to determine the amount of the crosslinking agents (B) on the basis of his or her general knowledge in the art, possibly with the aid of simple rangefinding experiments. Advantageously, the crosslinking agent (B) is present in the coating material of the invention in an amount of from 5 to 60, with particular preference from 10 to 50, and in particular from 15 to 45% by weight, based in each case on the solids content of the coating material of the invention. It is further advisable here to choose the amounts of crosslinking agent (B) and binder (A) such that in the coating material of the invention the ratio of functional groups (b1) in the crosslinking agent (B) to functional groups (a2) in the binder (A) is from 2:1to 1:2, preferably from 1.5:1 to 1:1.5, with particular preference from 1.2:1 to 1:1.2, and in particular from 1.1:1 to 1:1.1.

The coating material or electrodeposition bath of the invention may comprise customary coatings additives (C) in effective amounts. Examples of suitable additives (C) are organic and/or inorganic pigments, anticorrosion pigments and/or fillers such as calcium sulfate, barium sulfate, silicates such as talc or kaolin, silicas, oxides such as aluminum hydroxide or magnesium hydroxide, nanoparticles, organic fillers such as textile fibers, cellulose fibers, polyethylene fibers or woodflour, titanium dioxide, carbon black, iron oxide, zinc phosphate or lead silicate; these additives may also be incorporated into the electrodeposition baths of the invention by way of pigment pastes, suitable grinding resins comprising the binders (A) described above;

free-radical scavengers;

organic corrosion inhibitors;

crosslinking catalysts such as organic and inorganic salts and complexes of tin, lead, antimony, bismuth, iron or manganese, preferably organic salts and complexes of bismuth and of tin, especially bismuth lactate, ethylhexanoate or dimethylolpropionate and dibutyltin oxide or dibutyltin dilaurate;

slip additives;

polymerization inhibitors;

defoamers;

emulsifiers, especially nonionic emulsifiers such as alkoxylated alkanols and polyols, phenols and alkylphenols or anionic emulsifiers such as alkali metal salts or ammonium salts of alkanecarboxylic acids, alkanesulfonic acids, and sulfo acids of alkoxylated alkanols and polyols, phenols and alkylphenols;

wetting agents such as siloxanes, fluorine compounds, carboxylic monoesters, phosphoric esters, polyacrylic acids and their copolymers, or polyurethanes;

adhesion promoters;

leveling agents;

film-formation auxiliaries such as cellulose derivatives;

flame retardants;

organic solvents;

low molecular mass, oligomeric and high molecular mass reactive diluents which can participate in thermal crosslinkings, especially polyols such as tricyclodecanedimethanol, dendrimeric polyols, hyperbranched polyesters, polyols based on metathesis oligomers or branched alkanes having more than eight carbon atoms in the molecule;

anticrater agents.

Further examples of suitable coatings additives are described in the textbook "Lackadditive" [Additives for coatings] by Johan Bieleman, Wiley-VCH, Weinheim, N.Y., 1998.

Finally, the invention teaches a method of coating electrically conductive substrates, in which (1) the electrically conductive substrate is dipped into an electrodeposition bath in accordance with the information given above, (2) the substrate is connected as the cathode or anode, preferably as the cathode, (3) a film is deposited on the substrate by means of direct current, (4) the coated substrate is removed from the electrodeposition bath, (5) the deposited coating film is baked, and (6) optionally, following step (5), a primer-surfacer, a stonechip protectant material and a solid-color topcoat material, or alternatively a basecoat material and a clearcoat material, are applied and baked, the basecoat material and the clearcoat material preferably being applied and baked by the wet-on-wet technique.

EXAMPLES

1. Preparation of the Crosslinking Agents (B)

1.1 Preparation of the Crosslinking Agent (B1)

A reactor equipped with a stirrer, reflux condenser, internal thermometer and inert gas inlet is charged under a nitrogen atmosphere with 10552 parts of isomers and more highly functional oligomers based on 4,4'-diphenylmethane diisocyanate having an NCO equivalent weight of 135 g/eq (Lupranat®, BASF/Germany; NCO functionality approximately 2.7; 2,2'- and 2,4'-diphenylmethane diisocyanate content less than 5%). 18 parts of dibutyltin dilaurate are added and 9498 parts of butyl diglycol are added dropwise at a rate such that the product temperature remains below 60° C. Cooling may be necessary. After the end of the addition, the temperature is held at 60° C. for a further 60 minutes and an NCO equivalent weight of 1120 g/eq is found (based on solids fractions). Following dilution in 7768 parts of methyl isobutyl ketone, 933 parts of melted trimethylolpropane are added at a rate such that the product temperature does not exceed 100° C. After the end of the addition, reaction is continued for 60 minutes more. On subsequent checking, NCO groups are no longer detectable. Cooling to 65° C. is accompanied by dilution with 965 parts of n-butanol and 267 parts of methyl isobutyl ketone.

The solids content is 70.1% (1 h at 130° C.).

1.2 Preparation of the Crosslinking Agent (B2)

A reactor equipped with a stirrer, reflux condenser, internal thermometer and inert gas inlet is charged under a nitrogen atmosphere with 12208 parts of isomers and more highly functional oligomers based on 4,4'-diphenylmethane diisocyanate having an NCO equivalent weight of 135 g/eq (Lupranat®, BASF/Germany; NCO functionality approximately 2.7; 2,2'- and 2,4'-diphenylmethane diisocyanate content less than 5%). 8 parts of dibutyltin dilaurate are added and 10499 parts of butyl diglycol are added dropwise at a rate such that the product temperature remains below 60° C. Cooling may be necessary. After the end of the addition, the temperature is held at 60° C. for a further 60 minutes and an NCO equivalent weight of 887 g/eq is found (based on solids fractions). Following dilution in 4500 parts of methyl isobutyl ketone, 1293 parts of melted trimethylolpropane are added at a rate such that the product temperature does not exceed 100° C. After the end of the addition, reaction is continued for 60 minutes more. On subsequent checking, NCO groups are no longer detectable. Cooling to 65° C. is accompanied by dilution with 599 parts of n-butanol and 893 parts of methyl isobutyl ketone.

The solids content is 80.5% (1 h at 130° C.).

2. Preparation of the Precursor (Solution of Diethylenetriamine Diketimine in Methyl Isobutyl Ketone)

From a 70 percent strength by weight solution of diethylenetriamine in methyl isobutyl ketone, the water of reaction is removed azeotropically at 110–140° C. This is followed by dilution with methyl isobutyl ketone until the solution has an amine equivalent weight of 127.

3. Preparation of Aqueous Dispersions Containing Cathodically Depositable Resins (A) and a Crosslinking Agent (B)

3.1 Preparation of the Aqueous Binder Dispersion (A/B1)

In a reactor equipped with a stirrer, reflux condenser, internal thermometer and inert gas inlet, 6150 parts of epoxy resin based on bisphenol A having an epoxy equivalent weight (EEW) of 188 are heated to 125° C. under a nitrogen atmosphere together with 1400 parts of bisphenol A, 335 parts of dodecylphenol, 470 parts of p-cresol and 441 parts of xylene and the mixture is stirred for 10 minutes. It is subsequently heated to 130° C. and 23 parts of N,N-dimethylbenzylamine are added. The reaction mixture is held at this temperature until the EEW has reached the level of 880 g/eq.

A mixture of 7097 parts of the crosslinking agent (B) [sic] and 90 parts of the additive K2000 (polyether, Byk Chemie/Germany) is then added and the resulting mixture is held at 100° C.

Half an hour later, 211 parts of butyl glycol and 1210 parts of isobutanol are added.

Immediately following this addition, a mixture of 467 parts of the precursor as per 2. (diethylenetriamine diketimine in methyl isobutyl ketone) and 520 parts of methylethanolamine is introduced into the reactor and the batch is brought to a temperature of 100° C. After a further half an hour, the temperature is raised to 105° C. and 159 parts of N,N-diemthylaminopropylamine are added.

75 minutes after the amine addition, 903 parts of Plastilit® 3060 (propylene glycol compound, BASF/Germany) are added and the mixture is diluted with 522 parts of propylene glycol phenyl ether (mixture of 1-phenoxy-2-propanol and 2-phenoxy-1-propanol, BASF/Germany), in the course of which it is cooled rapidly to 95° C.

After 10 minutes, 14821 parts of the reaction mixture are transferred to a dispersing vessel. 474 parts of lactic acid (88% in water), dissolved in 7061 parts of deionized water, are added in portions with stirring. The mixture is subsequently homogenized for 20 minutes before being diluted further with an additional 12600 parts of deionized water in small portions.

The volatile solvents are removed by vacuum distillation and then replaced by an equal volume of deionized water.

The dispersion (A/B1) has the following characteristics:
Solids content:

33.8% (1 h at 130° C.)

29.9% (½ h at 180° C.)

Base content:

0.71 milliequivalents/g solids (130° C.)

Acid content:

0.36 milliequivalents/g solids (130° C.)

pH:

6.3

Particle size:

116 nm (Mass average from photon correlation spectroscopy).

3.2 Preparation of the Aqueous Binder Dispersion (A/B2)

The preparation of the binder dispersion (A/B2) takes place in complete analogy to the binder dispersion (A/B1), except that directly following dilution with propylene glycol phenyl ether 378 parts of K-KAT® XP 348 (bismuth 2-ethylhexanoate; 25% bismuth, King Industries, USA) are admixed to the organic stage with stirring. After cooling, 14821 parts of the reaction mixture are dispersed in exactly the same way as for (A/B1).

The dispersion (A/B2) has the following characteristics:
Solids content:

33.9% (1 h at 130° C.)

30.1% (½ h at 180° C.)

Base content:

0.74 milliequivalents/g solids (130° C.)

Acid content:

0.48 milliequivalents/g solids (130° C.)

pH:

5.9

Particle size:

189 nm (Mass average from photon correlation spectroscopy).

3.3 Preparation of the Aqueous Binder Dispersion (A/B3)

In a reactor equipped with a stirrer, reflux condenser, internal thermometer and inert gas inlet, 6824 parts of epoxy resin based on bisphenol A having an epoxy equivalent weight (EEW) of 188 are heated to 130° C. under a nitrogen atmosphere together with 1984 parts of bisphenol A, 2527 parts of ethoxylated bisphenol A having an OH number of 222 (Dianol® 265, Akzo/Netherlands) and 597 parts of methyl isobutyl ketone. Then 16 parts of N,N-dimethylbenzylamine are added and the mixture is heated to 150° C. and held at a temperature between 150 and 190° C. for about 30 minutes. It is then cooled down to 140° C. This is followed by the addition of 21 parts of N,N-dimethylbenzylamine, and the temperature is maintained until the EEW has reached a level of 1120 g/eq.

Then 10113 parts of the crosslinking agent (B2) are added and the temperature is lowered to 100<C.

Subsequently, a mixture of 634 parts of the precursor (diethylenetriamine diketimine in methyl isobutyl ketone; cf. Section 2) and 597 parts of methylethanolamine are introduced into the reactor and the reaction mixture is held at 115° C. for one hour until a viscosity of approximately 6 dpa.s (50% dilution in methoxypropanol, cone and plate viscometer at 23° C.). Then 648 parts of propylene glycol phenyl ether (mixture of 1-phenoxy-2-propanol and 2-phenoxy-1-propanol, BASF/Germany) are added.

After 10 minutes the entire reaction mixture is transferred to a dispersing vessel. 609 parts of lactic acid (88% in water) and 152 parts of emulsifier mixture (mixture of 1 part of butyl glycol and 1 part of a tertiary acetylene glycol (Surfynol 104, Air Products/USA)), dissolved in 30266 parts of deionized water, are added in portions with stirring.

The volatile solvents are removed by vacuum distillation and then replaced by an equal volume of deionized water.

The dispersion (A/B3) has the following characteristics:
Solids content:

37.0% (1 h at 130° C.)

34.1% (½ h at 180° C.)

Base content:

0.53 milliequivalents/g solids (130° C.)

Acid content:

0.32 milliequivalents/g solids (130° C.)

pH:

6.6

Particle size: 150 nm (Mass average from photon correlation spectroscopy).

4. Preparation of Aqueous Solutions of Polyvinyl Alcohol (Co)Polymers (D)

4.1 Preparation of an Aqueous Solution of Poly(Vinyl Alcohol-Co-Vinyl Acetate) (D1)

Poly(vinyl alcohol-co-vinyl acetate):
Mowiol® 47-88, Clariant/Germany
Weight average molar mass: 228 000 daltons (*)
Polyvinyl alcohol content: 89.2%
Polyvinyl acetate content: 10.8% (**)

(*) Weight average molar mass by light scattering (+15% error) following reacetylation: 5 g of poly(lvinyl alcohol-co-vinyl acetate) are heated at 100° C. for 24 hours with 75 ml of reacetylating agent (pyridine/acetic anhydride/acetic acid 1:10:10); reprecipitation from methanol in water.

(**) Calculated from ester number in accordance with DIN 53401.

A reactor equipped with a stirrer, reflux condenser, internal thermometer and inert gas inlet is charged with 28491 parts of deionized water at room temperature. 1500 parts of poly(vinyl alcohol-co-vinyl acetate) in the form of fine granules are stirred continuously into the initial water charge and the mixture is then heated to 80° C. with stirring. On reaching 80° C., the mixture is held with stirring for two hours, the polymer being fully dissolved. This is followed by cooling to 35° C.

The viscous solution is stabilized against bacterial infestation with 9 parts of Parmetol® K40 (Schülke and Mayr/Germany).

The solids content of the solution is 5.0% (1 h at 130° C.).

4.2 Preparation of an Aqueous Solution of Poly(Vinyl Alcohol-Co-Vinyl Acetate-Co-Ethylene) (D2)

Poly(vinyl acetate-co-ethylene):
Laboratory product, BASF AG, Germany
Weight average molar mass: 239 000 daltons (*)

Polyvinyl acetate content: 92.8% (**)
Polyethylene content: 7.2%
(*) Weight average molar mass by light scattering (+15% error).
(**) Calculated from ester number in accordance with DIN 53401

In a reactor equipped with a stirrer, reflux condenser and internal thermometer, 1000 ml of 1% strength methanolic sodium hydroxide solution are heated to 50° C. Over the course of 30 minutes a solution of poly(ethylene-co-vinyl acetate) in methanol (300 g in 2000 ml of methanol) is added dropwise with stirring. After the end of the addition, reaction is continued for 30 minutes and the precipitate is isolated, washed alkali-free with methanol and dried in vacuo at approximately 40° C.

The product formed was characterized:

Poly(vinyl alcohol-co-vinyl acetate-co-ethylene):
Weight average molar mass: 215 000 daltons (*)
Polyvinyl alcohol content: 83.3%
Polyvinyl acetate content: 9.5% (**)
Polyethylene content: 7.2%
(*) Weight average molar mass by light scattering (+15% error) following reacetylation: 5 g of poly(vinyl alcohol-co-vinyl acetate-co-ethylene) are heated at 100° C. for 24 hours with 75 ml of reacetylating agent (pyridine/acetic anhydride/acetic acid=1:10:10); reprecipitation from methanol in water.
(**) Calculated from ester number in accordance with DIN 53401

In analogy to the procedure in Section 4.1, an aqueous solution of poly(vinyl alcohol-co-vinyl acetate-co-ethylene) is prepared.

The solids content of the solution is 5.0% (1 h at 130° C.).

5. Preparation of the Pigment Pastes 5.1 Preparation of the Gray Pigment Paste (P1)

5.1.1 Preparation of a Grinding Resin Solution having Tertiary Ammonium Groups

In accordance with EP 0 505 445 B1, Example 1.3, an aqueous-organic grinding resin solution is prepared by reacting, in the first stage, 2598 parts of bisphenol A diglycidyl ether (epoxy equivalent weight (EEW) 188 g/eq), 787 parts of bisphenol A, 603 parts of dodecylphenol and 206 parts of butyl glycol in a stainless steel reaction vessel in the presence of 4 parts of triphenylphosphine at 130° C. until an EEW of 865 g/eq is reached. In the course of cooling, the batch is diluted with 849 parts of butyl glycol and 1534 parts of D.E.R.® 732 (polypropylene glycol diglycidyl ether, DOW Chemical, USA) and is reacted further at 90° C. with 266 parts of 2,2'aminoethoxyethanol and 212 parts of N,N-dimethylaminopropylamine. After 2 hours the viscosity of the resin solution is constant (5.3 dPa.s; 40% in Solvenon® PM (methoxypropanol, BASF/Germany); cone and plate viscometer at 23° C.). It is diluted with 1512 parts of butyl glycol and the base groups are partly neutralized with 201 parts of glacial acetic acid, and the product is diluted further with 1228 parts of deionized water and discharged.

This gives a 60% strength aqueous-organic resin solution whose 10% dilution has a pH of 6.0.

The resin solution is used in direct form for paste preparation.

5.1.2 Preparation of the Pigment Paste

For this purpose, a premix is first formed from 1897 parts of water and 1750 parts of the resin solution described above. Then 21 parts of Disperbyk® 110 (Byk-Chemie GmbH/Germany), 14 parts of Lanco Wax® PE W 1555 (Langer & Co./Germany), 42 parts of carbon black, 420 parts of aluminum hydrosilicate ASP 200 (Langer & Co./Germany), 2667 parts of titanium dioxide TI-PURE® R 900 (DuPont, USA) and 189 parts of di-n-butyltin oxide are added. The mixture is predispersed for 30 minutes under a high-speed dissolver stirrer. The mixture is subsequently dispersed in a small laboratory mill (Motor Mini Mill, Eiger Engineering Ltd, Great Britain) for from 1 to 1.5 h to a Hegmann fineness of less than or equal to 12 $\mu$m and adjusted to solids content with additional water.

A separation-stable pigment paste P1 is obtained.

Solids content:

60.0% (½ h at 180° C.)

5.2 Preparation of the Gray Pigment Paste (P2)

5.2.1 Preparation of a Grinding Resin Solution Having Sulfonium Groups

An aqueous-organic sulfonium grinding resin solution is prepared by reacting, in the first stage, 2632 parts of bisphenol A diglycidyl ether (epoxy equivalent weight (EEW) 188 g/eq), 985 parts of bisphenol A, and 95 parts of nonylphenol in a stainless steel reaction vessel in the presence of 1 part of triphenolphosphine at 130° C. until an EEW of 760 g/eq is reached. In the course of cooling, the temperature is lowered to 80° C. with 996 parts of 2-butoxypropanol.

Then 603 parts of thiodiethanol (50% in water) are added and the mixture is stirred for 15 minutes. Following the addition of 661 parts of dimethylolpropionic acid and 152 parts of deionized water, the acid number is measured.

The reaction is over when the acid number is less than 5 (mg KOH per g solids). Then 10541 parts of deionized water are added in stages.

This gives a 28% strength aqueous-organic resin solution (solids content at 130° C., 60 min: 28.0%).

The resin solution is used in direct form for paste preparation.

5.2.2 Preparation of a Grinding Resin Solution having Quaternary Ammonium Groups First of all, in a reactor, 7507 parts of the 2-ethyl-hexanol monourethane of tolylene diisocyanate (90%) are added to 2040 parts of dimethylethanolamine at a rate such that the temperature does not exceed 70° C. This mixture is then diluted with 2199 parts of butyl glycol, and 2751 parts of lactic acid (88%) and 2170 parts of deionized water are added. The temperature rises to 90° C. After 3 hours the reaction product, used subsequently as quaternizing reagent, is discharged.

An aqueous-organic grinding resin solution having quaternary ammonium groups is prepared by reacting, in the first stage, 3512 parts of bisphenol A diglycidyl ether (epoxy equivalent weight (EEW) 188 g/eq), 1365 parts of bisphenol A, and 128 parts of xylene at 130° C. in a stainless steel reaction vessel in the presence of 4 parts of triphenylphosphine until an EEW of 740 g/eq is reached. During the reaction the temperature is raised to 180° C. The mixture is cooled and, at 125° C., 1947 parts of the 2-ethylhexanol monourethane of tolylene diisocyanate (90%) are added. The temperature is held for about 2 hours until isocyanate groups are no longer detectable by IR. Following dilution with 4893 parts of butyl glycol, the temperature is adjusted to 75° C. and 3198 parts of the quaternizing reagent described above are added.

When the acid number is less than 1 (mg KOH per g solids), dilution is carried out with 1457 parts of butyl glycol.

This gives a 56% strength resin solution (solids content at 130° C., 60 min: 56.0%).

The resin solution is used in direct form for paste preparation.

5.2.3 Preparation of the Pigment Paste

For this purpose, a premix is first formed from 1863 parts of water and 4119 parts of the above-described grinding resin solution having sulfonium groups (Section 5.2.1) and 422 parts of the above grinding resin solution having quaternary ammonium groups (Section 5.2.2). Then 728 parts of aluminum hydrosilicate ASP 200 (Langer & Co./Germany), 185 parts of carbon black, 6142 parts of titanium dioxide TI-PURE® R 900 (DuPont, USA) and 3639 parts of di-n-butyltin oxide are added. The mixture is predispersed for 30 minutes under a high-speed dissolver stirrer. The mixture is then dispersed in a small laboratory mill (Motor Mini Mill, Eiger Engineering Ltd, Great Britain) for from 1 to 1.5 h to a Hegmann fineness of less than or equal to 12 $\mu$m and is adjusted to solids with additional water.

A separation-stable pigment paste (P2) is obtained.

Solids content:

61.5% (½ h at 180° C.)

6. Preparation of Inventive Electrocoat Materials

The fractions of the components in the electrodeposition baths are set out in Tabs. 1, 2, and 3. Pigment-free and pigmented electrodeposition baths are the result.

These electrocoat materials comprise mixtures of in each case one aqueous dispersion (A/B) and deionized water. In the selective cases, pigment paste (P) is added with stirring to the resultant mixtures.

The aqueous solutions of polyvinyl alcohol (co)polymers (D) may be incorporated by adding them to the binder dispersion (A/B) or pigment paste (P) with stirring, or by subsequent addition to the binder/paste mixture, as in the present case.

TABLE 1

Gray pigmented electrocoat materials based on the binder dispersion (A/B1) and the pigment paste (P1)

| Electrocoat material | Comparative trial C1 | Example 1 | Example 2 |
|---|---|---|---|
| Polyvinyl alcohol | | | |
| (co)polymer 1) | 0 ppm 1) | 600 ppm 1) | 600 ppm 1) |
| Weight fractions (parts) | | | |
| Binder disp. (A/B1) | 491 | 491 | 491 |
| Pigment paste (P1) | 120 | 120 | 120 |
| Deionized water | 389 | 377 | 377 |
| Soln. of the polyvinyl alcohol | | | |
| (co)polymer | | | |
| (D1) | | 12 | |
| (D2) | | | 12 |
| TOTAL | 1000 | 1000 | 1000 |

1) Amount of polyvinyl alcohol (co)polymer (D) in the electrodeposition bath in ppm based on mass of electrodeposition bath

TABLE 2

Unpigmented electrocoat (clearcoat) materials based on the binder dispersion (A/B2)

| Electrocoat material | Comparative trial C2 | Example 3 | Example 4 |
|---|---|---|---|
| Polyvinyl alcohol | | | |
| (co)polymer 1) | 0 ppm 1) | 1500 ppm 1) | 600 ppm 1) |

TABLE 2-continued

Unpigmented electrocoat (clearcoat) materials based on the binder dispersion (A/B2)

| Electrocoat material | Comparative trial C2 | Example 3 | Example 4 |
|---|---|---|---|
| Weight fractions (parts) | | | |
| Binder disp. (A/B2) | 498 | 498 | 498 |
| Deionized water | 502 | 462 | 462 |
| Soln. of the polyvinyl alcohol | | | |
| (co)polymer | | | |
| (D1) | | 40 | |
| (D2) | | | 40 |
| TOTAL | 1000 | 1000 | 1000 |

1) Amount of polyvinyl alcohol (co)polymer (D) in the electrodeposition bath in ppm based on mass of electrodeposition bath

TABLE 3

Gray pigmented electrocoat materials based on the binder dispersion (A/B3) and the pigment paste (P2)

| Electrocoat material | Comparative trial C3 | Example 5 | Example 6 |
|---|---|---|---|
| Polyvinyl alcohol | | | |
| (co)polymer 1) | 0 ppm 1) | 600 ppm 1) | 600 ppm 1) |
| Weight fractions (parts) | | | |
| Binder disp. (A/B3) | 416 | 416 | 416 |
| Pigment paste (P2) | 105 | 105 | 105 |
| Deionized water | 479 | 467 | 467 |
| Soln. of the polyvinyl alcohol | | | |
| (co)polymer | | | |
| (D1) | | 12 | |
| (D2) | | | 12 |
| TOTAL | 1000 | 1000 | 1000 |

1) Amount of polyvinyl alcohol (co)polymer (D) in the electrodeposition bath in ppm based on mass of electrodeposition bath 7. Deposition of Inventive Electrocoat Materials After aging at room temperature for 5 days, deposition is carried out on a steel test panel connected as the cathode, with a series resistance of 150 ohm.

Water-rinsed, zinc-phosphated steel test panels from Chemetall 3) (Bo26 W OC) were used for this purpose. The deposition time was 2 minutes at a bath temperature of 32° C. The deposition voltage was chosen so as to give a baked film thickness of approximately 20 $\mu$m.

The deposited coating film is rinsed with deionized water and baked at 180° C. for 20 minutes. The resultant baked coating films were tested.

The test results may be seen from Tables 4 and 5.

7.1 Result of the depositions

As comparative examples, cathodically depositable electrodeposition baths without additions of polyvinyl alcohol (co)polymers were deposited (see also Section 6, Tabs. 1–3).

The film thicknesses reported are dry film thicknesses.

TABLE 4

Test results of electrodeposition baths based on the binder dispersions (A/B1) and (A/B2)*) with and without pigment paste (P1)

| Electro-deposition baths Examples (see Sect. 6; | Gray pigmented | | | Unpigmented (clearcoat) | | |
|---|---|---|---|---|---|---|
| Tabs. 1 + 2) | C1 | 1 | 2 | C2 | 3 | 4 |
| Binder dispersion | (A/B1) | " | " | (A/B2)*) | " | " |
| Pigment paste | (P1) | " | " | — | — | — |
| PVA1-CP solution (1) | — | (D1) | (D2) | — | (D1) | (D2) |
| Amount of PVA1-CP in bath (2), ppm | 0 | 600 | 600 | 0 | 2000 | 2000 |
| Deposition on zinc phosphate steel test panels (3) Film thickness (μm) | 20.7 | 20.9 | 20.2 | 20.6 | 19.2 | 19.3 |
| Voltage, V | 300 | 310 | 300 | 320 | 320 | 320 |
| Electrical rating (4) as measure of edge coverage, % | 6 | 100 | 97 | 8 | 88 | 73 |
| Leveling (5) | 2 | 3 | 3 | 2 | 2 | 3 |
| Corrosion protection of the 10 cycles of alternating-climate testing (6) | | | | | | |
| Scribe creep, mm (7) | 2.3 | 2.1 | 2.1 | 2.3 | 2.1 | 2.3 |
| Surface rust (8) | 1 | 1 | 1 | 1 | 1 | 1 |
| Edge rust (9) | 3 | 1 | 1 | 4 | 1 | 2 |
| Corrosion protection according to edge coating test Ford test method BI 127-01 (10) | | | | | | |
| No. of rust spots on a blade (10) | >80 | 19 | 21 | >80 | 29 | 35 |
| Oil splash compatibility (11) by BASF test method MEB0123A Cratered area as a % of total area (11): | >80 | ≦10 | ≦10 | >80 | ≦10 | ≦10 |

*) Note: (A/B2) corresponds to (A/B1) with the addition of bismuth carboxylate catalyst (see Section 3.2)

TABLE 5

Test results of electrodeposition baths based on the binder dispersions (A/B3) with pigment paste (P2)

| Electrodeposition baths | Gray pigmented | | |
|---|---|---|---|
| Examples (see Sect. 6; Tab. 3) | C3 | 5 | 6 |
| Binder dispersion | (A/B3) | " | " |
| Pigment paste | (P2) | " | " |
| PVA1-CP solution (1) | — | (D1) | (D2) |
| Amount of PVA1-CP in bath (2), ppm | 0 | 600 | 600 |
| Deposition on zinc phosphate steel test panels (3) Film thickness (μm) | 20.2 | 19.9 | 20.3 |
| Voltage, V | 310 | 310 | 310 |
| Electrical rating (4) as measure of edge coverage, % | 12 | 99 | 95 |
| Leveling (5) | 2 | 3 | 3 |
| Corrosion protection of the 10 cycles of alternating-climate testing (6) | | | |
| Scribe creep, mm (7) | 2.6 | 2.4 | 2.4 |
| Surface rust (8) | 1 | 1 | 1 |
| Edge rust (9) | 3 | 1 | 1 |

TABLE 5-continued

Test results of electrodeposition baths based on the binder dispersions (A/B3) with pigment paste (P2)

| Electrodeposition baths | Gray pigmented | | |
|---|---|---|---|
| Examples (see Sect. 6; Tab. 3) | C3 | 5 | 6 |
| Corrosion protection according to edge coating test Ford test method BI 127-01 (10) | | | |
| No. of rust spots on a blade (10) | >80 | 22 | 24 |
| Oil splash compatibility (11) by BASF test method MEB0123A Cratered area as a % of total area (11): | >80 | ≦10 | ≦10 |

(1) PVA1-CP: Polyvinyl alcohol copolymer PVA1-CP solution: Polyvinyl alcohol copolymer solution (for preparation see Section 4)

(2) PVA1 copolymer (polyvinyl alcohol copolymer): Amount as solids based on electrodeposition bath in ppm (see also Section 6, Tabs. 1 and 2)

(3) 2 minutes' deposition at 32° C. on Bo26 W60 OC steel test panels (water-rinsed, zinc-phosphated steel test panels; water rinse pH=6.0; Chemetall)

(4) This rating is determined by applying a voltage of 50–1000 V to the coated edge and determining the insulating effect against breakdown. The test panels used are again water-rinsed, zinc-phosphated steel test panels (3) and are measured on the 90° edge. The higher the electrical rating (max. 100), the higher the insulating effect. The higher the insulating effect, the better the coating of the edge with a film of electrocoat material.

(5) 1 best score; 5 worst score (6) 10 cycles of alternating-climate testing in accordance with VDA [German Automakers' Association]

(7) Creep [mm]=(total creep [mm]—scribe thickness [mm]): 2

(8) 0=best score; 5=worst score (9) 0=best score; 5=worst score

(10) Coated phosphated knife blades with a special 38° cutting geometry (Embee blade No. 172; Embee Corp., USA) are subjected to a 168 hour salt spray test (Ford test method BI 103-01), after which the number of rust spots appearing on the knife edge is assessed. The smaller the number of rust spots, the better the edge protection.

(11) Oil splash compatibility test method MEB0123A of BASF Coatings AG; test oil: Anticorit® RP 4107S (Fuchs Mineralölwerke GmbH/Germany): the oil splash compatibility of an electrocoat material is investigated following contamination with a crater-causing test oil during baking. The percentage fraction of the cratered area is evaluated. The smaller this area, the better the oil splash compatibility of the material. For the test, coated metal sample panels with unbaked air-dried electrocoat films are baked at 180° C. for 15 minutes in the presence of a test oil/water mixture. The arrangement is such that the test oil splashes in a defined manner onto the sample panel during baking. As a result of this procedure, craters are formed in the baked coating, with the percentage area affected relative to the total area serving as a measure of the oil splash compatibility. For evaluation, the fraction of the cratered and uncratered area units is determined within a lattice network of defined lattice spacings. If, for example, max. 10% of the total area is cratered, the result is evaluated as <10%. The gradations are as follows: less than/equal to 10%, 11–20%, 21–40%, 41–80%, greater than 80%.

What is claimed is:

1. An aqueous electrodeposition bath comprising (A) a binder, wherein the binder is depositable cathodically or anodically, (B) a dissolved polyvinyl alcohol (co)polymer comprising units of the following structure (I) —[—$C(R^1)_2$—$C(R^1)(OH)$—]—, wherein each $R^1$ in the structure is independently at least one of hydrogen, an alkyl, a substituted alkyl, a cycloalkyl, a substituted cycloalkyl, alkylcycloalkyl, substituted alkylcycloalkyl, cycloalkylalkyl, substituted cycloalkylalkyl, aryl, substituted aryl, alkylaryl, substituted alkylaryl, cycloalkylaryl, substituted cycloalkylaryl, arylalkyl, substituted arylalkyl, arylcycloalkyl, and substituted arylcycloalkyl, and (C) optionally at least one of a crosslinking agent and a coatings additive, wherein at least one of:

(i) at least one $R^1$ in the structure is not hydrogen, (ii) the polyvinyl alcohol (co)polymer comprises a reaction product of structure (I) with at least one of a structure (II) —[—$C(R^1)_2$—$C(R^1)(OC(O)R^2)$—]—, wherein $R^1$ is as previously defined, and $R^2$ is a $C_1$–$C_{10}$ alkyl; a (meth)acrylic acid ester substantially free from acid groups; a monomer that carry at least one hydroxyl group per molecule and that are substantially free from acid groups; a monomer that carry per molecule at least one acid group that can be converted into a corresponding acid anion group; a vinyl ester of a $C_5$–$C_{18}$ alpha-branched monocarboxylic acid; a cyclic olefin, an acyclic olefin; (meth)acrylamide; a monomer containing an epoxide group; a vinylaromatic hydrocarbon; a nitrile; a vinyl monomer; and/or an allyl monomer, and/or (iii) the polyvinyl alcohol (co)polymer is a copolymer of vinyl alcohol and at least one ethylenically unsaturated monomer.

2. The aqueous electrodeposition bath of claim 1, wherein the polyvinyl alcohol (co)polymer has a vinyl alcohol fraction of from 50 to 99.9 mol %.

3. The aqueous electrodeposition bath of claim 1, wherein the weight average molecular mass of the polyvinyl alcohol (co)polymer is from 10,000 to 500,000 daltons.

4. The aqueous electrodeposition bath of claim 1, wherein the polyvinyl alcohol (co)polymer is present in the electrodeposition bath in an amount from 2 to 10,000 ppm based on total weight of the electrodeposition bath.

5. The aqueous electrodeposition bath of claim 1, wherein the coatings additive is at least one of an organic pigment, an inorganic pigment, an anticorrosion pigment, a filler, a free-radical scavenger, an organic corrosion inhibitor, a crosslinking catalyst, a slip additive, a polymerization inhibitor, a defoamer, an emulsifier, a wetting agent, an adhesion promoter, a leveling agent, a film-formation auxiliary, a flame retardant, an organic solvent, a reactive diluent that can participate in thermal crosslinking, and an anticrater agent.

6. A method for coating an electrically conductive substrate, comprising (1) dipping the electrically conductive substrate into an electrodeposition bath as claimed in claim 1, (2) connecting the substrate as one of the cathode or anode, (3) applying a current to the substrate to deposit a film on the substrate, (4) removing the substrate with the deposited film from the electrodeposition bath, (5) baking the deposited coating film, and, (6) optionally, following step (5), one of:

i) applying and baking a primer-surfacer, a stonechip protectant material, and a solid-color topcoat material, and ii) applying and baking a basecoat material and a clearcoat material.

7. The method of claim 6, wherein the polyvinyl alcohol (co)polymer has a vinyl alcohol fraction of from 50 to 99.9 mol %.

8. The method of claim 6, wherein the weight average molecular mass of the polyvinyl alcohol (co)polymer is from 10,000 to 500,000 daltons.

9. The method of claim 6, wherein the polyvinyl alcohol (co)polymer is present in the electrodeposition bath in an amount from 2 to 10,000 ppm based on total weight of the electrodeposition bath.

10. The method of clam 6, wherein the coatings additive is at least one of an organic pigment, an inorganic pigment, an anticorrosion pigment, a filler, a free-radical scavenger, an organic corrosion inhibitor, a crosslinking catalyst, a slip additive, a polymerization inhibitor, a defoamer, an emulsifier, a wetting agent, an adhesion promoter, a leveling agent, a film-formation auxiliary, a flame retardant, an organic solvent, a reactive diluent that can participate in thermal crosslinking, and an anticrater agent.

* * * * *